US005486152A

United States Patent [19]

Heinz et al.

[11] Patent Number: 5,486,152

[45] Date of Patent: Jan. 23, 1996

[54] CARTON CLOSING PLOUGH AND PROCESS

[75] Inventors: Daniel J. Heinz, Joppa; Gregory A. Lathrop, Manchester, both of Md.; Lawrence W. Caldwell, Hanover, Pa.; Pasquale Buzzeo, Westminster, Md.

[73] Assignee: Lever Brothers Company, Division of Conopco, Inc., New York, N.Y.

[21] Appl. No.: 319,356

[22] Filed: Oct. 6, 1994

Related U.S. Application Data

[63] Continuation of Ser. No. 17,065, Feb. 12, 1993, abandoned, which is a continuation-in-part of Ser. No. 15,951, Feb. 10, 1993, abandoned.

[51] Int. Cl.[6] ..... B65H 45/22

[52] U.S. Cl. ..... 493/468; 493/178; 493/183; 493/438; 493/455

[58] Field of Search ..... 493/178, 179, 493/183, 468, 438, 439, 440, 455; 53/377.2

[56] References Cited

U.S. PATENT DOCUMENTS

| | | | |
|---|---|---|---|
| 4,144,800 | 3/1979 | Hughes | 93/49 R |
| 4,233,798 | 11/1980 | Helding | 53/76 |
| 4,551,810 | 11/1985 | Levine . | |
| 4,554,635 | 11/1985 | Levine . | |
| 4,570,421 | 2/1986 | Focke | 53/491 |
| 4,578,054 | 3/1986 | Herrin | 493/126 |
| 4,614,512 | 9/1986 | Capdeboscq | 493/441 |
| 4,741,728 | 5/1988 | Baky | 493/131 |

OTHER PUBLICATIONS

Construction Technology V. Lockformer Case, filed Nov. 7, 1990, obtained from Lexis.

Marks' Standard Handbook for Mechanical Engineers, 7th Ed. pp. 8–6.

Italian ACMA E–2436.

Carleton Inc. Product Brochure "BMH Invertor and Rotational Positioner".

*Primary Examiner*—Jack W. Lavinder

*Attorney, Agent, or Firm*—Gerard J. McGowan, Jr.

[57] ABSTRACT

A plough for closing carton flaps, particularly major carton flaps and a process for making the plough. The plough is designed to cause the flaps to close at or near constant velocity so as to minimize disruptions on the manufacturing line. The plough is prepared by generating data describing the coordinates of a flap as it closes at or near constant velocity, using the data to generate additional data describing the contour of a plough necessary to close the flap at or near constant velocity, and causing the plough to be fabricated utilizing the contour data.

7 Claims, 4 Drawing Sheets

CARTON CLOSING PLOUGH AND PROCESS

This is a continuation application of Ser. No. 08/017,065, filed Feb. 12, 1993, now abandoned which is a continuation-in-part application of Ser. No. 08/015,951, filed Feb. 10, 1993 now abandoned.

BACKGROUND OF THE INVENTION

In a modern manufacturing facility, cartons are generally closed automatically by machines. Typically, artisans have custom designed a system of rods for the particular type of closure desired. In designing such a system, the artisan uses his or her judgment as to the length, angular disposition and number of rods required to close the carton. Considering, for instance, the closure of the top major flaps of the carton, a rod might be required to begin closure of the inner major flap from a position generally parallel to the longitudinal axis of the carton and toward the closed position perpendicular to the longitudinal axis of the carton. The first rod might move the flap say 20 degrees toward the closed position, after which a second rod would be positioned to move the flap the next 30 degrees and so forth until the entire 90 degrees or more from the open position to the closed position has been achieved.

The design of appropriate rods has been more a matter of art than science, since it is difficult to create rods with precisely the positions necessary to close the carton flaps smoothly.

Carton flap closures have also been accomplished automatically by means by ploughs or rails which have a particular curvature intended to be suited to closing the flaps of a carton. Unfortunately, here again, design of the ploughs has been empirical in that an artisan must exercise his/her judgment in obtaining a curvature suited to closing the carton at issue.

Powder cartoning equipment from the Italian company ACMA is supplied with cast plow blocks.

Third power polynomial forms for displacement of cams adapted from Gutman, Machine Design, March, 1951 are given in Table 1 on page 8–6 of Marks' Standard Handbook for Mechanical Engineers, 7th Edition, McGraw-Hill, Theodore Baumeister, Editor, the disclosure of which is incorporated by reference herein.

It is important in a manufacturing process that closure of the flaps be continuous and smooth. Any aberrations may cause a stoppage on the line with consequent increase in cost of production. When the rods or ploughs impart anything other than a smooth continuous motion to the flaps, the potential for stoppage of the line exists. For instance, any jerky sudden movements caused by the ploughs or rods may cause a disruption of the packing line.

SUMMARY OF THE INVENTION

We have discovered ploughs which are capable of imparting extremely smooth and continuous motion to the flaps. That is, the ploughs of the invention cause the flaps to move at or near the ideal path at or near constant velocity. When flaps move at other than constant velocity, i.e., when they accelerate or decelerate, the possibility for disruption is increased. We have also discovered a process for designing and making ploughs which imparts to the flaps a velocity at or near constant velocity.

In accordance with the invention, the coordinates for the ideal path of the flaps at constant velocity are calculated and are then used to generate the shape of the plough. Preferably, the coordinates are obtained from CAD software which determines points through which the flap will pass. Then the coordinates are used, preferably by appropriate software in a microprocessor, to calculate the surface of the plough which is required to produce constant velocity or close to constant velocity. The data thus generated can be used by a microprocessor linked to manufacturing means whereby the plough is automatically manufactured according to the plough surface specifications calculated by the microprocessor.

In accordance with the invention, it is possible to produce a plough which imparts to carton flaps at least 90% of constant velocity, preferably at least 95% and most preferably 98 to 100% of constant velocity. Typically, the plough imparts 99% and above of constant velocity. Similarly, the angular differences between increments (as defined below) over the length of the plough folding surface should not exceed 1%, and preferably not exceed 0.5%.

For a more complete understanding of the above and other features and advantages of the invention, reference should be made to the following detailed description of a preferred embodiment and to the accompanying drawings.

DETAILED DESCRIPTION OF THE INVENTION

Figure 1:
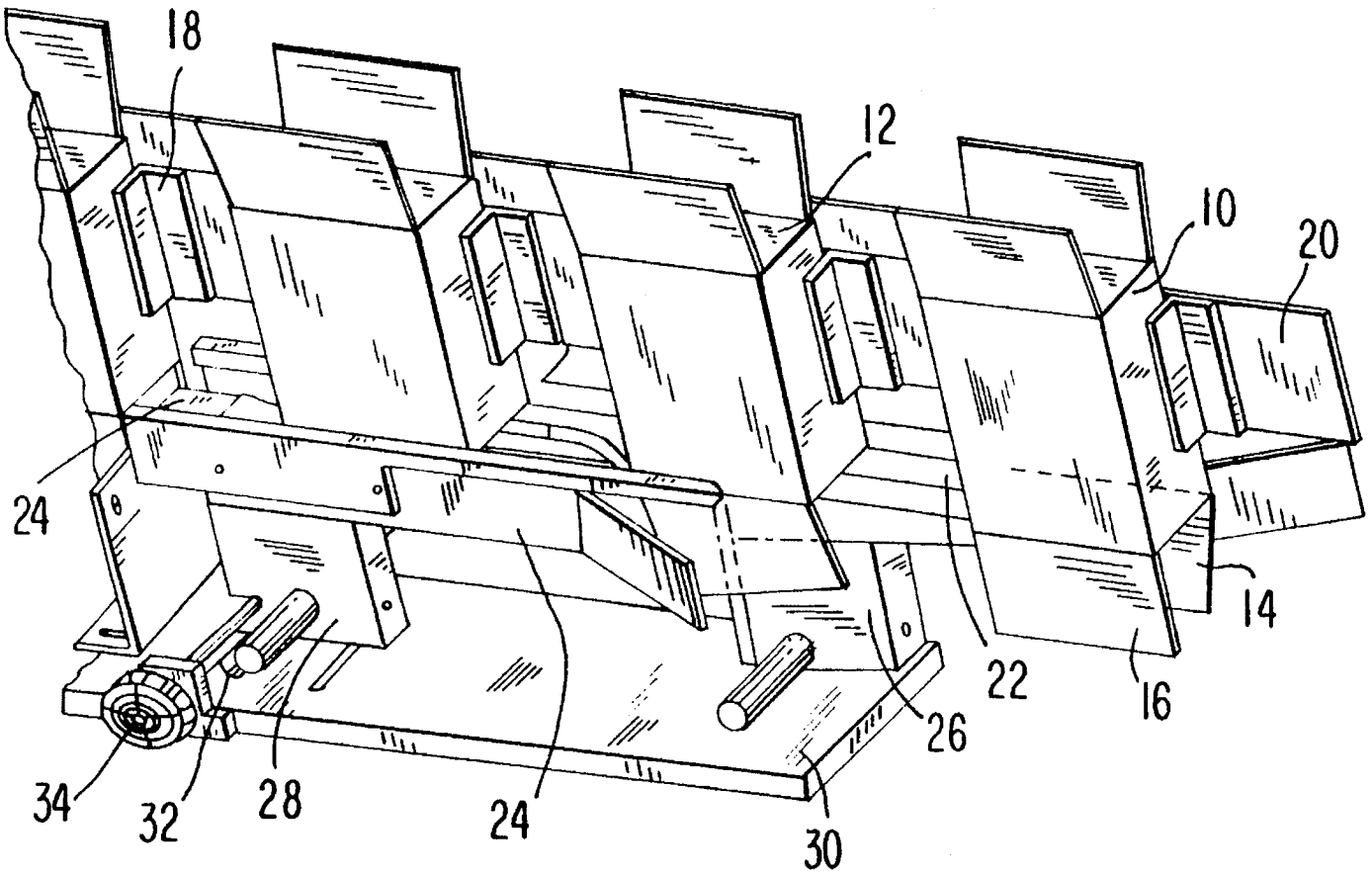
FIG. 1 perspective view of a carton closing line in accordance with the invention.

As seen in FIG. 1, cartons 10 are conveyed initially with minor flaps 12 in the closed position perpendicular to the longitudinal axis of the carton and with inner and outer major flaps 14 and 16 respectively parallel to the longitudinal axis of the carton or nearly so. Typically the cartons will be conveyed at constant velocity.

The cartons are carried by grasping arms 18 on conveyer belt 20. Ploughs or rails 22 and 24 according to the invention are provided to fold the bottom inside and outside major flaps into closed position. Plough 22 rests on supporting block 26 and plough 24 rests on supporting block 28. The supporting blocks rest on base 30. The distance between the rails is adjustable by use of adjusting screw 32 which can be turned by handle 34.

Rails 22 and 24 are contoured to provide a curvature which imparts to the bottom major flaps an obstacle to the force moving the cartons forward, which obstacle causes the flap to close at constant or near constant velocity. Closing the flaps at near constant velocity avoids disruptions on the line and their consequent economic costs. Rails 62 and 64 seen in FIG. 2 are similar to rails 22 and 24 except that rail 64 would contact the carton flap first whereas rail 22 contacts the flap 14 first in FIG. 1.

Figure 2:
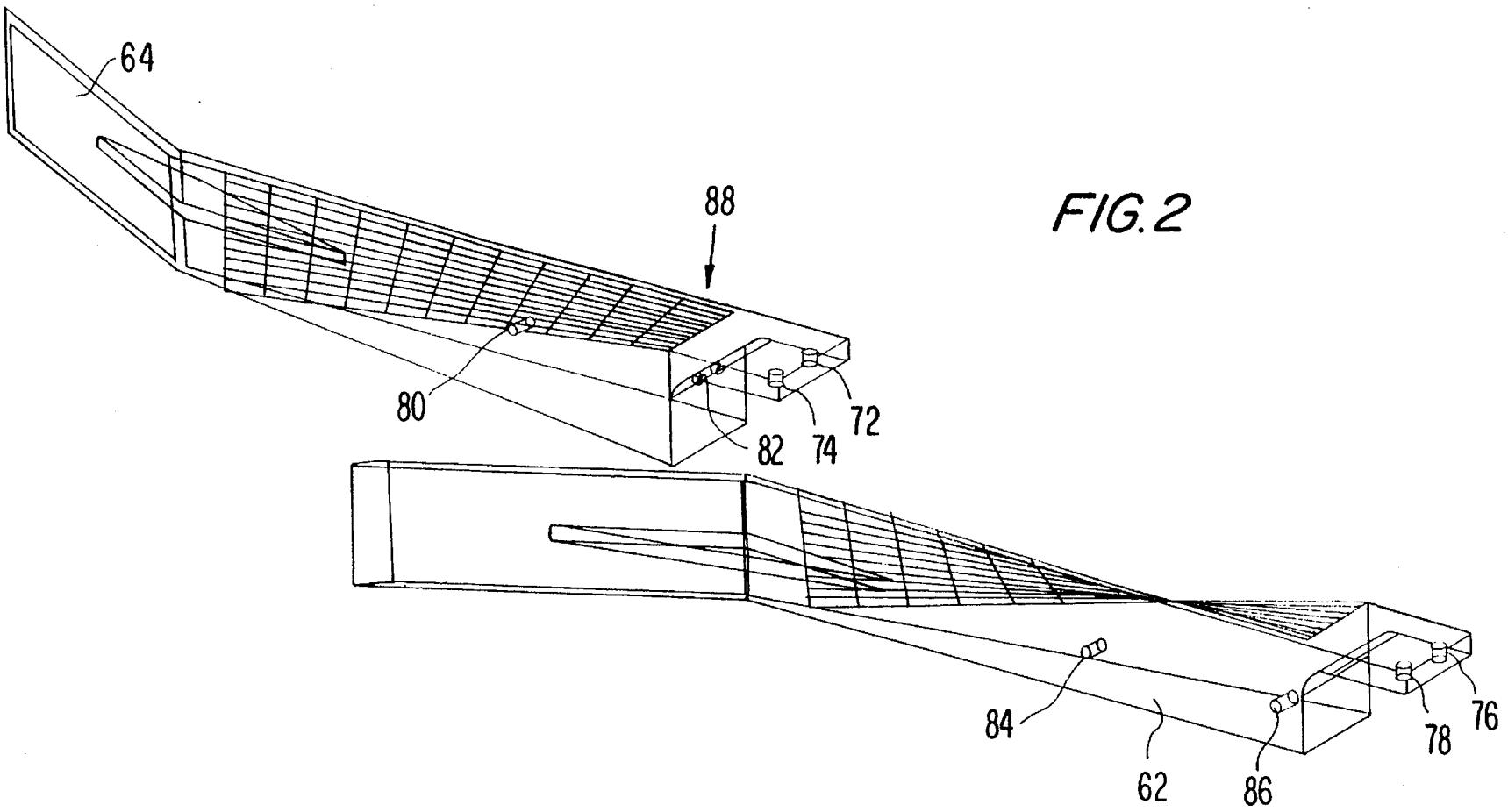
FIG. 2 is a perspective view of a pair of ploughs according to the invention.

As seen in FIG. 2, rails 64 and 62 include side fastening apertures 80, 82 and 84, 86, respectively which are used to mount carton side guides. Fastening apertures 72, 74 and 76, 78, respectively in rails 64 and 62 are used to mount extensions, not shown in FIG. 2, which hold the folded flaps up.

Rails 22, 24, 62 and 64 were produced by generating the coordinates in space and time of the inside and outside major flaps as they travel at constant velocity along the line. This was accomplished by drawing a CAD representation of a specific carton with major flaps open and then moving the carton on the screen in even increments progressively to close both flaps within a specified distance. The coordinates are used by a computer program to generate data describing the rail. That is, using a common point on the leading edge of each flap as they close, approximately in the center of the major flaps, the program uses a third order polynomial to create cubic spline curved surfaces to form the two opposite folding rails. A spline is the smoothest possible free form curve which can be created with specified points. The data was generated using Unigraphic II design software (UGII) sold by Electronic Data Systems Corp. of Maryland Heights, Mo.

The profile of the rails created defines the curvature necessary for the two rails to close the flaps at or near constant velocity. UGII accepts up to 1000 points for creation of the spline. The data thus generated was fed into computer driven machining equipment which fabricated the plough. The HP 9000 Series 700 Advance Net Computers from Hewlett Packard were used in the fabrication of the ploughs. Computer machining equipment such as vertical machining centers VMC4020, VMC4020HT and VMC40 from Fadal Engineering Co., Inc., North Hollywood, Calif. may be used. Motion in at least 2½ axes is desired.

Figure 6:
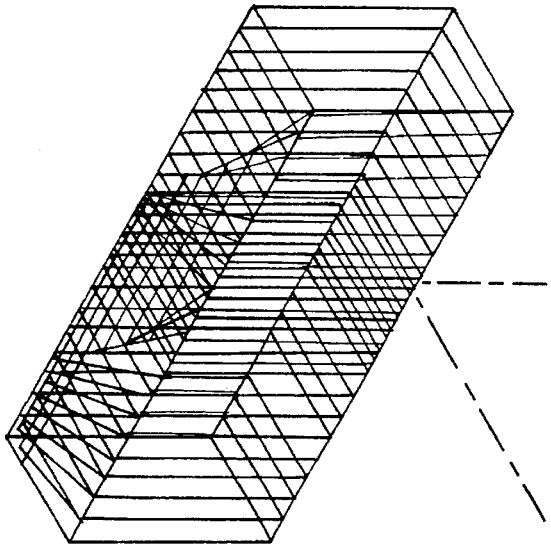
FIG. 6 is a perspective view of a carton as it closes in accordance with the invention.
Figure 3:
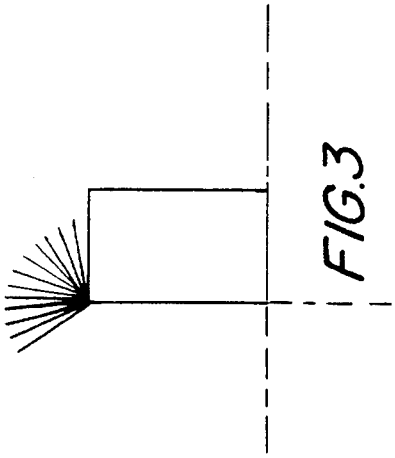
FIG. 3 is a schematic view from the side of the various stages of an outside major carton flap as it closes in accordance with the invention.
Figure 5:
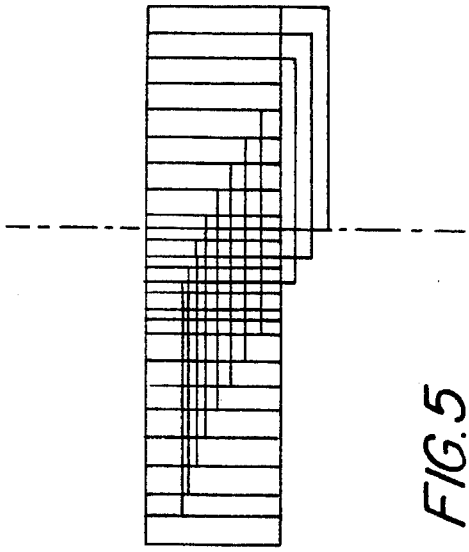
FIG. 5 is a view from the top of a carton as it closes in accordance with the invention.
Figure 4:
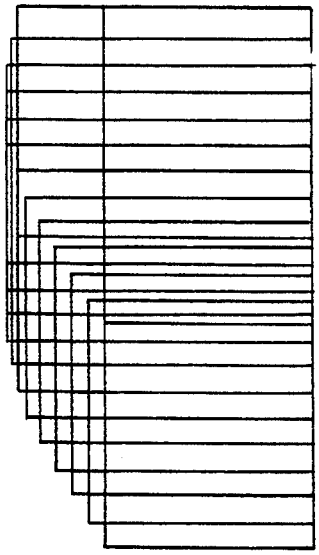
FIG. 4 is a schematic view showing the front profile of a carton as the outer major flap closes in accordance with the invention traveling from left to right.
Figure 7:
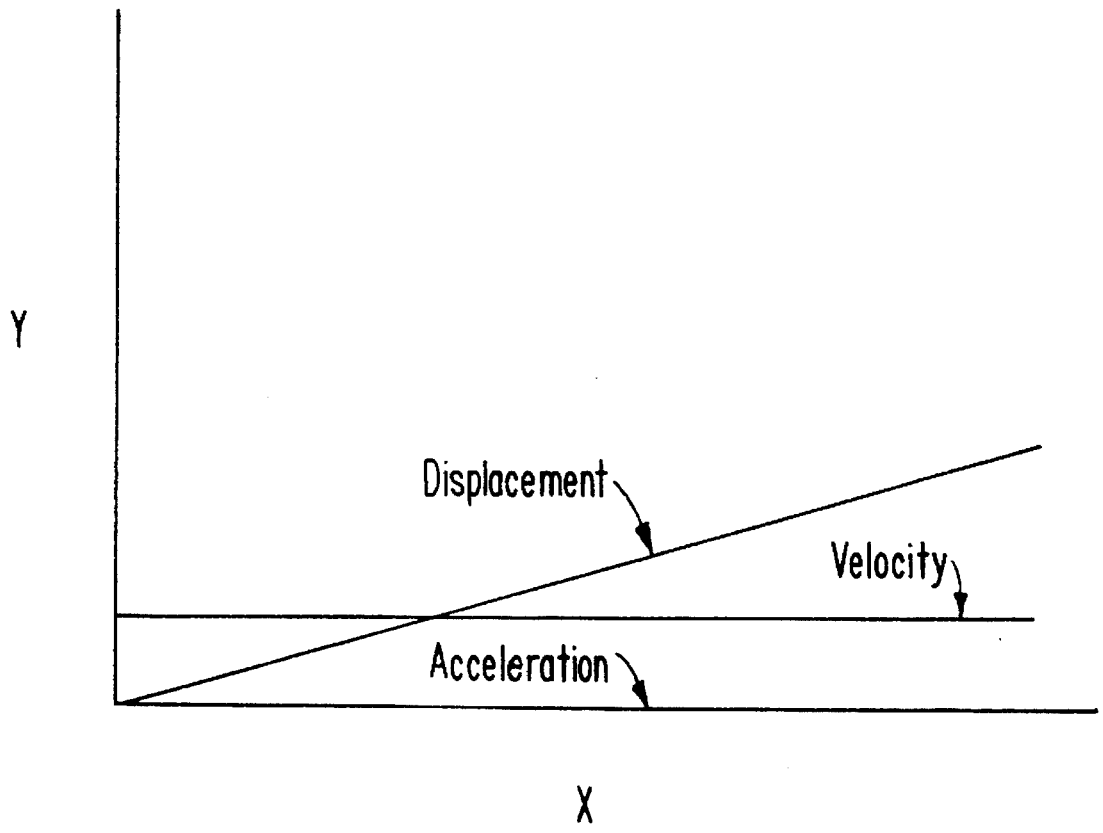
FIG. 7 is a diagram showing a constant velocity curve.

Prior to and during closing of the carton flaps the carton is conveyed by carrier blocks as shown in FIG. 1, at a constant velocity as shown in FIGS. 4, 5 and 6 denoted by equal incremental spaces. When a major flap contacts the folding plow, the flap is pushed close by the cubic spline curved surface of the plough derived from Unigraphic II design software. As shown in FIG. 3, this curve closes the flap at a rate consistent with constant velocity, zero acceleration and linear displacement as shown in the diagram of FIG. 7, with accompanying mathematical characteristics.

As can be seen in FIG. 3, the constant velocity of the flap is constant angular velocity.

Constant velocity is desirable because the flap closes at a constant speed corresponding to the carton's forward motion. Zero acceleration is desirable because the closure force remains constant. This eliminates inertial forces caused by accelerations per Newton's law of F=MA. This combines to apply constant stress on the carton joint which results in reducing flap skew and in a squarer carton fold. The cubic spline curved surface also provides a flat surface about ¼ to ½ the carton flap length which remains parallel to the flap surface during closure. This limits warping of the flap when the closure force is applied. Prior art which employed round rod construction localized stress which tended to warp the carton flap, when closed, around the rod, resulting in a skewed fold.

In accordance with the invention, it is possible to produce a plough with a 99% accurate constant velocity curve. The Unigraphic II design software allows a tolerance value to be entered to control the ripple between defined points. The present invention uses 0.001 as this value for a mathematical accuracy of 99.99%.

The ploughs are preferably made of aluminum coated with Martin Hardcoat having a 0.005 inch thickness and 40 Rc hardness with Teflon impregnation for lubricity. The coating may be obtained from Eastern Plating, Inc. of Baltimore, Md.

In operation, as conveyer belt 20 moves forward at a predetermined speed, it approaches rail 22. Rail 22 contacts inner major flap 14 and is shaped so as to push inner flap 14 inwardly at or near constant velocity to the closed position wherein the flap is perpendicular to the longitudinal or vertical axis of the carton. Once inner major flap 14 is sufficiently closed, plough 24 contacts outer major flap 16. Plough 24 is likewise contoured to impart a smooth, continuous closing motion to outer major flap 16 as the carton is conveyed past the plough. The result is that both of the bottom major flaps lead edges are closed at or near constant velocity so that disruptions on the packaging line are minimized.

Subsequent to closure of the flaps, pressure is applied to seal them. For instance, prior to closure, hot melt or other sealants may have been applied to the flaps. After the bottom major flaps are sealed, the top major flaps will approach a plough arrangement similar to that shown in FIG. 1 except that the plough apparatus will be inverted and proximate to the top of the cartons.

As used herein, "within 90% of constant velocity" means that if a curve is plotted showing the velocity, over 90% of the length of the curve would comprise a straight, horizontal line (See FIG. 6).

A preferred measure of how close a plough is to developing perfect constant velocity involves calculating the angular differences over the length of the folding surface of the plough. Use of a coordinate measuring machine such as those available from Sheffield Measurement Co. of Dayton, Ohio, is preferred.

While the illustrated ploughs close top and bottom flaps, they could also be positioned to close flaps disposed elsewhere on the carton, e.g., the side, front or back.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A plough having a contour with a surface having the curvature necessary for closing a flap of a carton at or within 90% of constant angular velocity when the carton is conveyed at constant velocity.

2. A pair of ploughs contoured to have surfaces having the curvatures necessary for closing a flap of a carton at or within 90% of constant angular velocity when the carton is conveyed at constant velocity.

3. The plough of claim 1 contoured to close the flap of the carton at or within 95% of constant velocity.

4. The plough of claim 3 contoured to close the flap of the carton at or near 98% of constant velocity.

5. The plough of claim 1 contoured to close an outer major flap.

6. The ploughs of claim 2 contoured to close an inner and an outer major flap of a carton, respectively.

7. The plough of claim 2 contoured to close an inner and an outer major flap at constant angular velocity.

* * * * *